US005488886A

United States Patent [19]

Mohr

[11] Patent Number: 5,488,886

[45] Date of Patent: Feb. 6, 1996

[54] METHOD OF OPTIMIZING A MACHINE THAT CUTS MATERIAL

[76] Inventor: Wolfgang Mohr, Hundshager Weg 42, D-65719 Hofheim/Taunus, Germany

[21] Appl. No.: 112,897

[22] Filed: Aug. 27, 1993

[30] Foreign Application Priority Data

Aug. 28, 1992 [DE] Germany ..... 42 28 651.4

[51] Int. Cl.[6] ..... B26D 7/02

[52] U.S. Cl. ..... 83/29; 83/282; 83/364; 83/375; 83/461; 83/466

[58] Field of Search ..... 83/13, 72, 74, 83/248, 282, 361, 365, 375, 452, 461, 466, 934, 29

[56] References Cited

U.S. PATENT DOCUMENTS

| | | | |
|---|---|---|---|
| 3,182,542 | 5/1965 | Cochran | 83/466 X |
| 4,757,731 | 7/1988 | Mohr | 83/72 X |
| 4,836,074 | 6/1989 | Mohr | 83/282 X |

FOREIGN PATENT DOCUMENTS

| | | |
|---|---|---|
| 1095254 | 12/1960 | Germany . |
| 1190431 | 4/1965 | Germany . |
| 2550477 | 5/1977 | Germany . |

*Primary Examiner*—Richard K. Seidel
*Assistant Examiner*—Raymond D. Woods
*Attorney, Agent, or Firm*—Max Fogiel

[57] ABSTRACT

A method for optimizing the cutting of sheets of material that are stacked on a bench in a cutting machine. Before cutting the sheets, a beam descends to hold the sheets fast while guillotine blade descends and cuts the sheets. After the sheets have been cut, the blade and beam are lifted, with the lower edge of the beam following the sharp edge of the blade. A definite distance between the blade and the top of the stack is determined while the blade rises after cutting the sheets. The rise of the blade is terminated at the upper end of that distance, which is determined by a pick-up mounted stationary on the holdfast beam. This pick-up detects the position of the rising blade in relation to the holdfast beam.

12 Claims, 3 Drawing Sheets

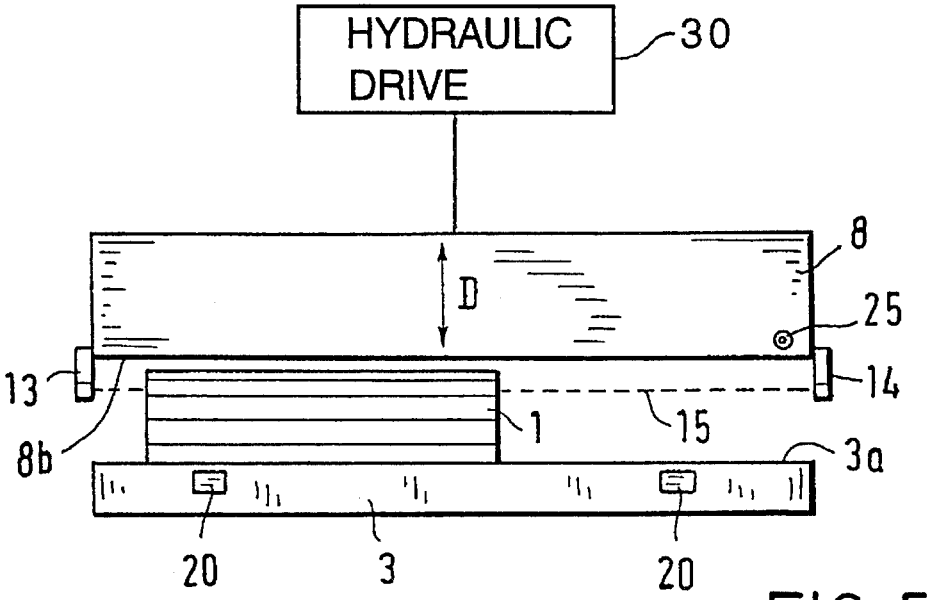
FIG. 5
FIG. 6
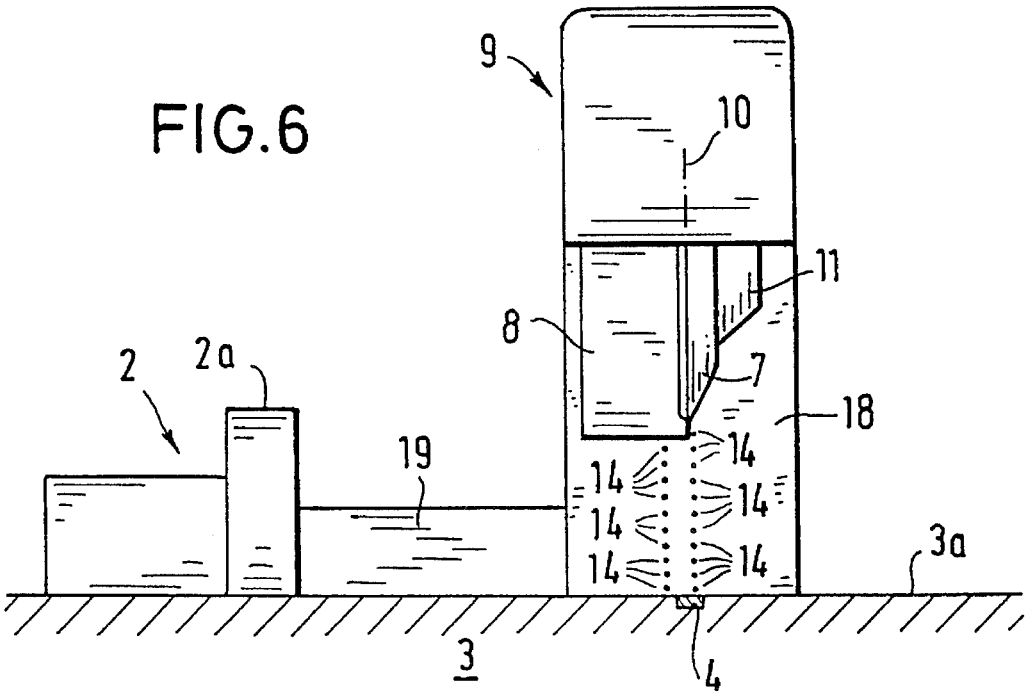

METHOD OF OPTIMIZING A MACHINE THAT CUTS MATERIAL

BACKGROUND OF THE INVENTION

The present invention concerns a method of and device for optimizing a machine that cuts material, especially stacked sheets of paper, cardboard, or similar material.

In a known machine for cutting such material the sheets are stacked on a bench and a hydraulic beam descends onto the stack to hold it fast while an adjacent guillotine blade descends perpendicularly to the surface of the bench and cuts through the material. Once the cut has been produced, the blade and the beam are lifted, with the lower edge of the beam following the sharp edge of the blade. Once the sharp edge of the blade is at the same level as the lower edge of the beam, which still rests on the material, the motion of the beam accordingly ensures that the beam will deflect the blade. This prevents the blade from injuring the operator. The beam generally does not rise again until the blade is in an invariable upper position. The beam itself rises into an invariable upper position. The invariable upper positions are slightly higher than the top of any stack of material that might be processed.

There is a drawback to such a machine in that the blade executes unproductive motions when a low stack is processed. Considerable time is lost while the blade descends onto the stack from its upper position and before it can proceed to actually cutting the material. Raising the blade to its upper position once the cut has been produced also takes considerable time. These long intervals considerably decelerate the overall process when the machine is operating automatically. The same drawback, slow processing, can also be ascribed to the time involved in raising and lowering the beam all the way up and down. This is particularly detrimental in that the material cannot be advanced along the surface until the beam is all the way up. The blade's and the beam's unproductive motions can in particularly last longer than it takes to advance a stack of small sheets, labels for example.

German AS 1 190 431 discloses not raising the hydraulically operated beam and blade in a machine that cuts material, especially staked sheets of paper, cardboard, or similar material as unprofitably high as is necessary in a machine that is gear-driven. The material can accordingly be advanced in this embodiment as soon as the blade and beam release the stack.

German AS 1 095 254 discloses switching circuitry for a machine that cuts material, especially stacked sheets of paper, cardboard, or similar material with a blade-accommodating beam and a mechanically controlled automatically operated holdfast beam. The holdfast beam is lifted out of the position in which it holds down the material by a device that actuates the beam's mechanisms and responds to the arrival of the blade-accommodating beam at a specific elevation. The device comprises a switch that includes a roller and a sloping surface that the roller rolls over, controlling the switch. The holdfast pressure is removed when the blade rises above the stack, which is precisely when the holdfast beam begins to rise. The upward motion of the holdfast beam is accordingly dictated by the upward motion of the blade, but the distance traveled by the holdfast beam is not dictated by the height of the stack.

A machine for cutting frozen meat etc. is known from German 2 550 477 B2. The blade operates in conjunction with another blade and is raised and lowered by hydraulic or pneumatic mechanisms. The stroke of the blade can be adjusted to the thickness of the meat to make the operation more economical. A stroke-end switch that can be raised or lowered is positioned in the vicinity of a trigger that travels along with the blade and operates in conjunction with the hydraulic or pneumatic drive. The trigger is actuated either manually or by a device that senses how thick the meat is.

SUMMARY OF THE INVENTION

The object of the present invention is a method of and a device for optimizing the process of cutting sheets of material in a machine with a blade and a holdfast beam.

The method of optimizing a machine that cuts material, especially stacked sheets of paper, cardboard, or similar material whereby the sheets are stacked on a bench and a hydraulic beam descends onto them to hold them fast while an adjacent guillotine blade descends perpendicularly to the surface of the bench and cuts the material and whereby once the material has been cut, the blade and the beam are lifted, with the lower edge of the beam following the sharp edge of the blade, is characterized in accordance with the invention in that a definite distance between the blade and the top of the stack is determined while the blade is rising subsequent to cutting the material and the rise of the blade is terminated at the upper end of that distance or slightly higher, whereby the definite distance is determined by a pick-up mounted stationary on the holdfast beam, the pick-up detects the position of the rising blade in relation to the holdfast beam, and the rise of the hydraulically operated holdfast beam is initiated for the purpose of determining the definite distance while the definite distance between the blade and the top of the stack is being determined or slightly thereafter.

A definite distance is at least the distance between the blade and the top of the stack once the holdfast beam has risen just high enough to allow the material to advance while ensuring that the holdfast beam covers the sharp edge of the blade. If for whatever reason, the holdfast beam arrives at its highest level any farther from the material, the blade will be raised higher. It may simultaneously be desirable not to position the blade in its outermost position in relation to the outermost position of the holdfast beam where the sharp edge of the blade is just still covered by the holdfast beam but for the holdfast beam to project farther out below the blade. What is essential to the present invention is that the blade rises after cutting out the material only as far as necessary to cut the next material from the aspect of removing the pressure exerted by the holdfast beam and of advancing the material that is to be cut. The level associated with the distance will accordingly depend primarily on how high a stack is actually being processed. Other characteristics essential to the solution enabled by the instant invention are that the holdfast beam resting on the material being cut provides a reference site for the blade in relation to the actual height of the stack of material being cut and that it is unnecessary to wait until the blade arrives at its highest level in relation to the actual height of the stack. The holdfast beam can be raised even while the blade is moving.

It is of advantage for the blade to be hydraulically actuated and for the blade's rise to terminate while the definite distance is being determined or slightly thereafter. This feature ensures that the blade will rise once the material has been cut only as far as the actual height of the stack necessitates and will descend onto the stack from that height to the same stack height prior to cutting the next material, assuming that the height of the stack remains constant.

Interposing a timer is significant in particular from the aspect that the material to be cut out can vary in hardness. It will be sufficient when the material is hard for example for the holdfast beam to rise only slightly, for which only a relatively short rise on the part of the blade will also be necessary. When the material is soft, however, and expands once the holdfast beam is removed, both the holdfast beam and the blade will have to rise farther to allow the material being cut to advance smoothly.

It is on the other hand also conceivable for the blade to be mechanically actuated by a crankshaft such that the definite distance is determined while the blade is rising and the blade descends once it has exceeded its upper dead center and the descent of the blade terminates at the height of the level of the distance or at a slightly higher level. The position of the crankshaft can in this case be represented for example by the position of a 360° graduated dial that operates in conjunction with it, with a definite numerical value on the dial corresponding to the definite distance that occurs as the blade descends. The descent of the blade will terminate as soon as the numerical value representing the definite distance that occurs as the blade descends is arrived at. The descent of the blade can also be terminated if desired at a numerical value that occurs earlier and represents a slightly higher level of distance. The descent can for example be terminated by disengaging the crankshaft's drive mechanism, especially an electric motor, from the crankshaft with a clutch and applying a brake to the crankshaft.

It is advantageous to terminate the motion of the blade while it is at a definite distance of 10 to 20 mm from the top of the stack. The sharp edge of the blade will in this event be at least 10 mm above the top of the stack without taking into account the expansion of the material being cut once the holdfast beam has been raised. If there is a timer, the definite distance will have to be shorter to ensure that the rise of the blade terminates at the definite distance of 10 to 20 mm from the material being cut.

It is practical for the pick-up on the holdfast beam to determine the position of the sharp edge of the blade. Since the blade is usually moved by traction and the sharp edge of the blade positioned paralleling the bench surface only at bottom dead center, it will be preferable for the pick-up to determine the vicinity of the lower end of the sharp edge of the blade. If the pick-up is mounted on the holdfast beam away from the beam's material-contact surface, the risen blade will basically be reliably covered by the holdfast beam. The pick-up can determine the position of the holdfast beam in relation to the blade inductively for example. This is practical in that both the holdfast beam and the blade are at any rate made of magnetic metal.

The mechanism that advances the material being cut can be actuated as the holdfast beam begins to rise in accordance with another practical embodiment. This feature minimizes both the blade's and the holdfast beam's unproductive motions. It is of advantage for a definite distance between the holdfast beam and the top of the stack to be determined while the holdfast beam is rising from the material being cut and for the rise of the holdfast beam to terminate while or after the definite distance is being determined. This will ensure that the holdfast beam too will rise only as far as the height of the stack necessitates once the material has been cut and will descend, assuming that the next stack is the same height, onto the material being cut from that height before the next material is cut. It is of advantage for the definite distance that the holdfast beam rises to equal the definite distance that the blade rises. The aforementioned effects of hard and soft material must be taken into account when deciding how high the holdfast beam is to rise. It will also be of advantage for the rise of the holdfast beam to terminate when it is 10 to 20 mm from the material being cut.

The definite distance between the lower edge of the holdfast beam and the top of the stack can be determined by a pick-up mounted stationary on the holdfast beam and following it as it rises for example. Since it is mounted stationary on the holdfast beam, the pick-up will rise to the same extent and will accordingly sense, due to its following the holdfast beam, the position of the top of the stack and in concrete terms accordingly the transition between the top of the stack and the air. As soon as the pick-up senses the top of the stack, the rise of the holdfast beam terminates or a timer that terminates the rise-of the holdfast beam is actuated. The latter operation will result in a definite entrainment on the part of the holdfast beam. The mechanism that advances the material being cut is in particular actuated once the definite distance between the holdfast beam and the material being cut has been determined.

In addition to continuous determination of the position of the lower edge of the holdfast beam in relation to the top of the stack it is also possible to discontinuously determine their positions and the position of the blade by way of several stationary determination sites that can be employed to determine the position of the holdfast beam, especially the lower edge of the holdfast beam and the top of the stack, and of the blade, especially the sharp edge of the blade. The precision of the distances between adjacent stationary determination sites makes it possible to predict the particular height of the stack, the distance, that is, between the top of the stack and the surface of the bench, as well as the distance between a mark on the holdfast beam, especially on the lower edge of the holdfast beam, and the surface of the bench, and the distance between a mark of the blade, especially the sharp edge of the blade, and the surface of the bench. This distance can then be employed to obtain information about the distance between the lower edge of the holdfast beam and the top of the stack and between the sharp edge of the blade and the top of the stack.

A preferred embodiment of the device for optimizing a machine that cuts material, especially stacked sheets of paper, cardboard or other material, has a surface for the stack to rest on, a mechanism that advances the material being cut, a beam that descends on the stack to hold it fast, and an adjacent guillotine blade that descends perpendicularly to the surface and cuts the material. The machine is characterized by a pick-up that is positioned on the side of the holdfast beam facing the blade and detects the position of the blade in relation to the holdfast beam. It is preferable for the pick-up to be an inductive proximity switch or metal detector remote from the beam's material-contact surface and detecting the sharp edge of the blade.

The hydraulically actuated holdfast beam can have below and outside its material-contact surface a sensor that acts parallel to the material-contact surface of the holdfast beam and detects the top of the stack. It is of advantage for the sensor to be a light barrier comprising a source of light and a photocell and positioned off the surface of the bench. The holdfast beam can accordingly descend to the surface of the bench without the surface, if of the conventional type, damaging the sensor. It would basically alternatively be possible to position the sensor above the bench surface and remove material from the surface to accommodate the sensor where it would collide with the surface when the holdfast beam is all the way down. It would it this case be necessary of course to keep any material being cut out of the range of the sensor.

In another preferred embodiment of the device the holdfast beam and the blade or blade holder are accommodated in a guillotine bent that has sensors at various distances above the surface of the bench, each sensor acting parallel to that surface, to determine the elevations of the top of the stack, the lower edge of the holdfast beam, and the sharp edge of the blade in relation to the surface. It is practical in this version as well for the sensors to be light barriers.

Further characteristics of the invention will be evident from the following specification and figures. All characteristics and combinations thereof are essential to the invention.

BRIEF DESCRIPTION OF THE DRAWINGS

Several embodiments of the invention will now be specified by way of example and without being limited to them in any way with reference to the drawing, wherein

FIG. 5 is a front view of the components of the machine relevant to the invention, and FIG. 6 is a section similar to FIG. 1 of a machine with several light barriers in its bent.

DESCRIPTION OF THE PREFERRED EMBODIMENTS

Figure 1:
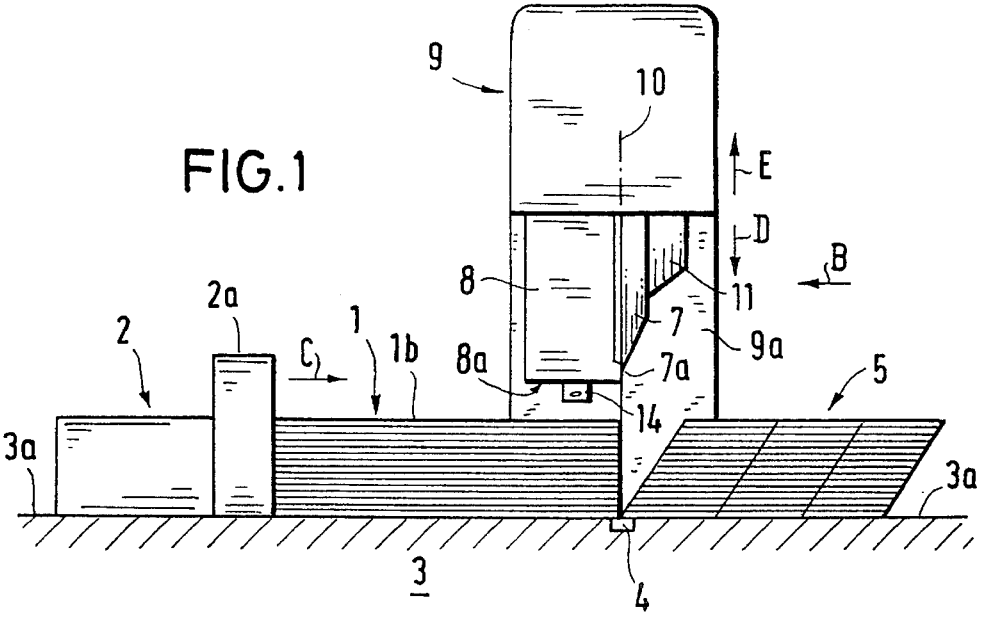
FIG. 1 is a schematic section along the line A—A in FIG. 2 through the top of a machine that cuts stacks of material, whereby the holdfast beam has a light barrier and an inductive proximity switch.
Figure 2:
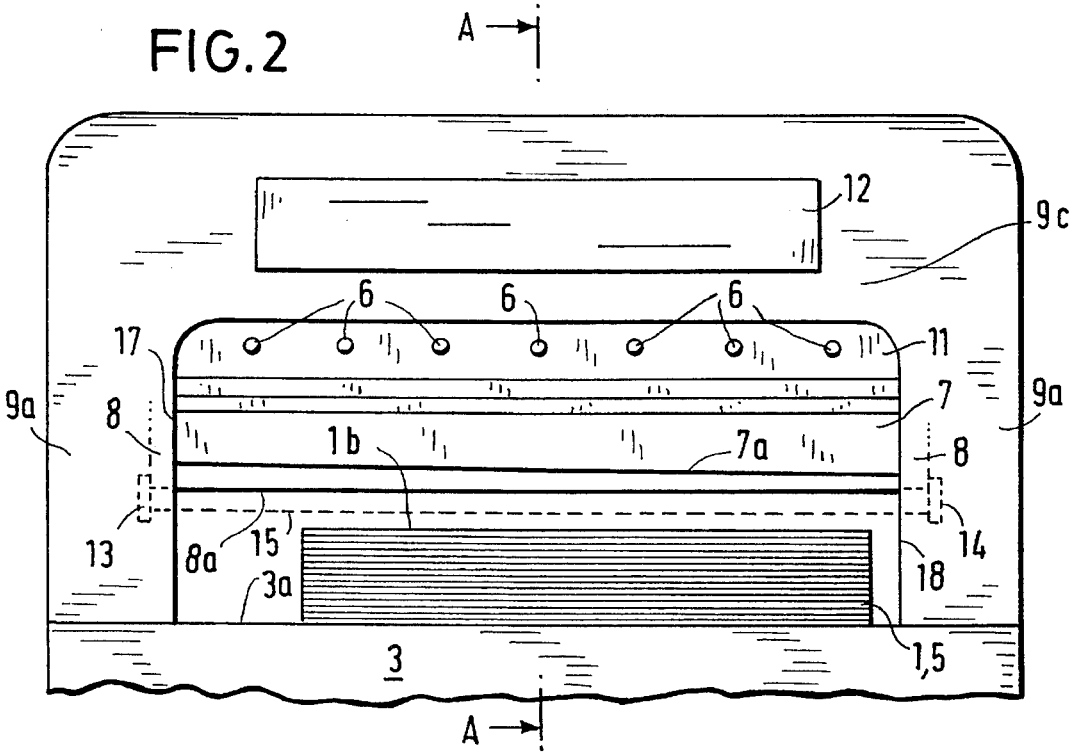
FIG. 2 is a front view of the machine from the direction indicated by arrow B in FIG. 1.

FIGS. 1 and 2 are highly schematic illustrations of the top of a guillotine-type machine for cutting material, especially stacked sheets of paper, cardboard, or similar material. The machine rests on an unillustrated base. The base accommodates a bench 3 for the stack to rest on and a bent 9. Embedded in and extending all the way across bench 3 is a blade-edge protector 4. Also extending all the way across the bench is a material-advancing mechanism 2 with a thruster 2a. Thruster 2a can be forwarded in the direction indicated by arrow C to produce the overall motion of the material while it is being cut. Upstream of blade-edge protector 4, the material 1 that is to be cut rests on the surface 3*a* of bench 3 and against thruster 2*a*. Downstream of blade-edge protector 4 is the material 5 that has been cut, in the form of three advanced stacks. Above blade-edge protector 4 is a blade 7, which is illustrated raised in FIGS. 1 and 2 and can descend as far as blade-edge protector 4 in the direction indicated by arrow D. Adjacent to blade 7 on the side facing material-advancing mechanism 2 is a holdfast beam 8, which is also illustrated raised in FIGS. 1 and 2 and can descend onto the material 1 that is to be cut. Blade 7 and holdfast beam 8 are accommodated in the machine's bent 9, which surrounds them at the top and sides. Blade 7 is fastened by screws 6 to a blade holder 11 in the form of a beam. The sharp edge 7*a* of blade 7 is at a slight angle to the horizontal. An unillustrated crankshaft moves blade 7 in an oblique shearing stroke. The crankshaft is actuated by a motor. The crankshaft is connected to the motor by a clutch as well as to a brake. The blade can accordingly be halted in any position by uncoupling the crankshaft from the motor. A graduated dial rotates along with the crankshaft and indicates its position.

As will also be evident from FIGS. 1 and 2 holdfast beam 8 is mounted with each end in one of the uprights 9a of bent 9 and can be moved up and down therein in the direction indicated by arrow D by a hydraulic drive 30 (FIG. 5). Blade 7 is mounted in blade holder 11 in the horizontal web 9*c* of bent 9. The slightly arched tracking of blade 7 is accomplished by way of unillustrated slides. Blade 7 separates the material along a plane 10 perpendicular to the surface 3*a* of bench 3 and extending through blade-edge protector 4. The machine is controlled from a panel 12.

The guillotine-type machine in the embodiment hereintofore specified and illustrated in FIGS. 1 through 6 has a sensor in the form of a light barrier comprising a source 13 of light and a photocell 14 below the material-contact surface 8*a* of holdfast beam 8. Source 13 of light and photocell 14 are positioned at opposite ends of holdfast beam 8 and accordingly beyond its material-contact surface 8*a*. Source 13 of light, photocell 14, and holdfast beam 8 are represented in FIG. 2 by broken lines in the vicinity of the uprights 9*a* of bent 9. The light 15 emitted by source 13 of light extends horizontally at a specific distance Z, 10 mm for example, below the material-contact surface 8*a* of holdfast beam 8.

Figure 3:
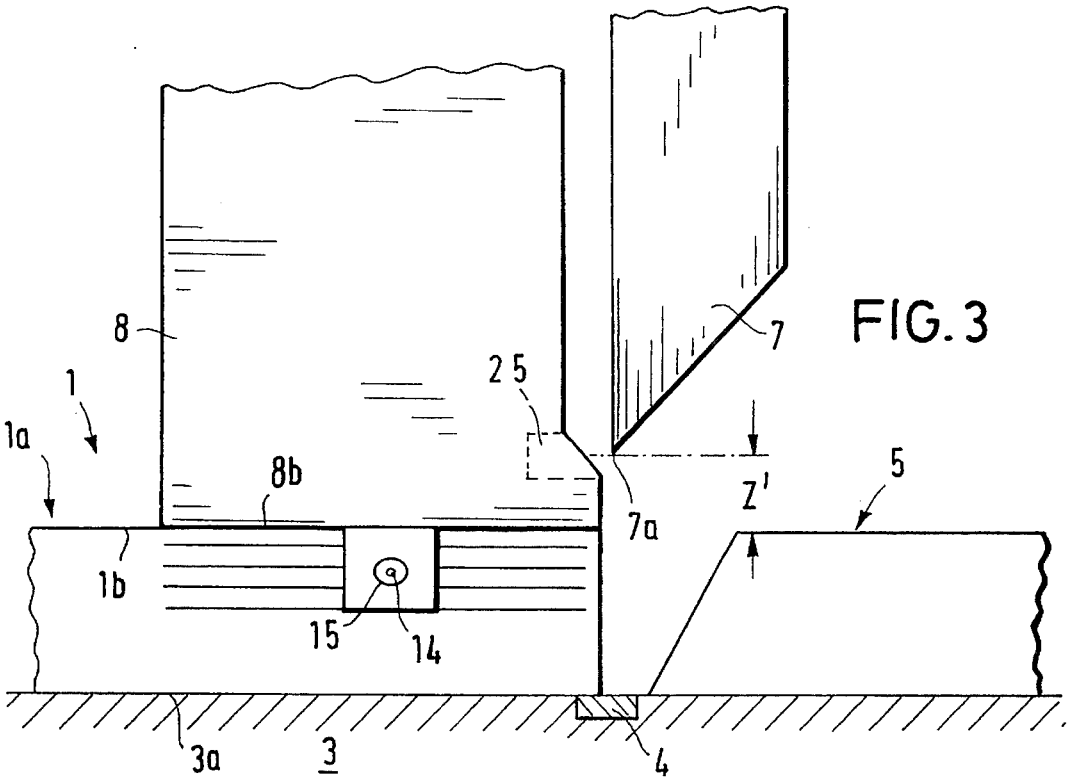
FIG. 3 is a detail of the actual material-cutting point in the machine illustrated in FIG. 1 upon termination of the rise of the blade above a low stack.

Holdfast beam 8 also has an inductive proximity switch 25 in the vicinity of its material-contact surface 8*a* and, as will be most evident from FIG. 5, which, for simplicity's sake does not include blade 7, near photocell 14. Also near photocell 14, as will be evident from FIG. 2, is the end of the sharp edge 7*a* of blade 7 that is slightly lower than the other end. Switch 25 is always actuated when the sharp edge 7*a* of blade 7 is in its vicinity, as illustrated in FIG. 3 and accordingly at a distance Z' from the material-contact surface 8*a* of holdfast beam 8. How the optimization device hereintofore specified operates and how the material is cut will now be specified.

Figure 4:
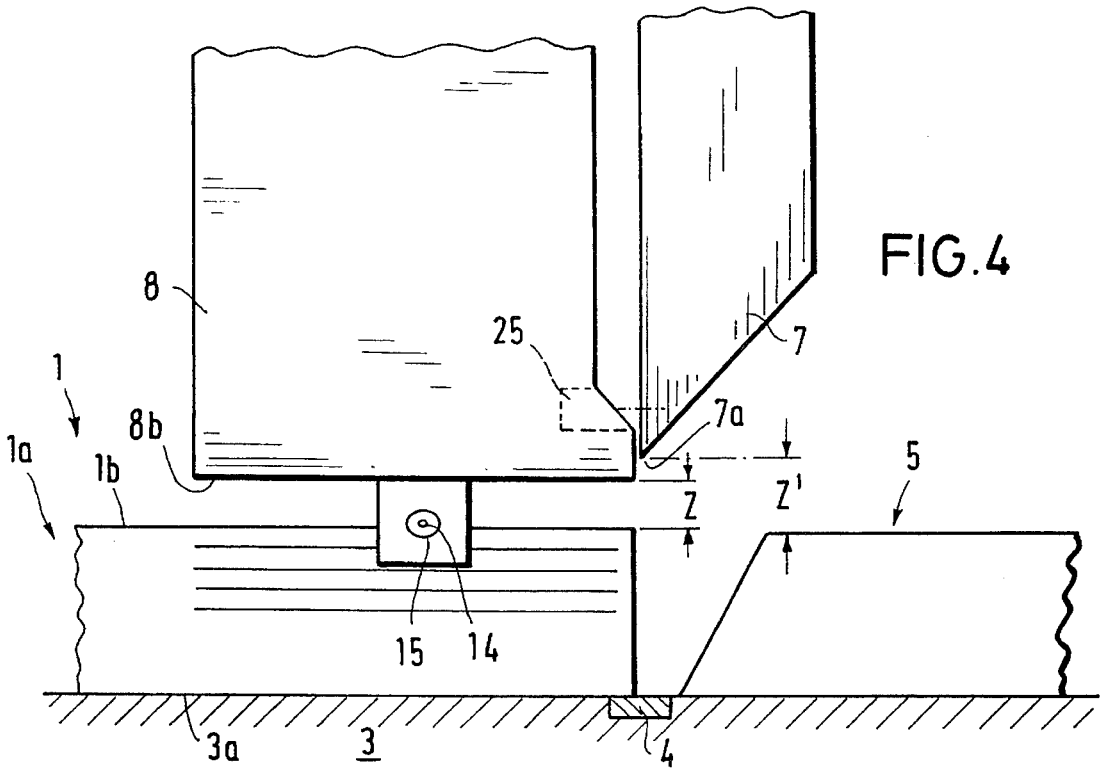
FIG. 4 is a detail similar to that in FIG. 3 upon subsequent termination of the rise of the holdfast beam.

Cutting can be initiated by pressing two buttons 20 on the front of bench 3. Holdfast beam 8 descends onto the material 1 that is to be cut. The light barrier is electrically connected during the cutting process and specifically once holdfast beam 8 has descended onto material 1 to the hydraulic mechanism that actuates the beam and is accordingly actuated when the material obstructs light 15. Once holdfast beam 8 is resting on the material 1 that is to be cut, blade 7 descends and cuts the material. The cross-section of the stack of material 5 that has been cut is distorted into a parallelogram by the wedge shape of blade 7. Blade 7 rises after cutting the material. As soon as switch 25 detects the sharp edge 7*a* of blade 7, the switch will actuate blade 7, uncoupling the crankshaft from the motor and immediately braking the crankshaft. Blade 7 will accordingly come to a halt on the same level as switch 25 and will remain at level Z and Z' or Z' above the surface 3*a* of bench 3 or above the top 1*a* of the material 1 that is to be cut. When switch 25 senses the presence of the sharp edge 7*a* of blade 7, the switch emits a signal that raises holdfast beam 8. With the position illustrated in FIG. 3 as a point of departure, the holdfast beam and light barrier rise until light 15 is no longer obstructed, which also indicates the definite distance Z between holdfast beam 8 and the material 1 that is to be cut. In this position the light barrier is disengaged and switches the electric circuit to immediately terminate the rise of holdfast beam 8. This situation is illustrated in FIG. 4, which also shows holdfast beam 8 covering up the sharp edge 7*a* of blade 7. Material-advancing mechanism 2 is actuated as soon as holdfast beam 8 rises definite distance Z above the material 1 that is to be cut. As soon as this mechanism has replaced the material, holdfast beam 8 descends onto the material out of the position illustrated in FIG. 4. Blade 7 descends out of the position illustrated in FIG. 3 and produces the cut. The blade rises again into the position illustrated in FIG. 3. Holdfast beam 8 returns to the position illustrated in FIG. 4. When a higher stack of material is cut after a lower stack, holdfast beam 8 and blade 7 are raised to their highest level by external controls and the position illustrated in FIG. 4 will prevail subsequent to the first cut.

FIG. 6 illustrates another embodiment with several horizontally active light barriers in the vicinity of the inner surfaces 17 and 18 of bent 9 instead of a single horizontally acting light barrier secured to the bottom of holdfast beam 8 and an inductive proximity switch 25 mounted on the beam. The light barriers determine the positions of holdfast beam 8, blade 7, and the material 1 that is to be cut. The material is, in order to facilitate comprehension of the overall machine, not illustrated in FIG. 6. Mounted on bench 3 is a lateral baffle 19. FIG. 6 illustrates two vertical rows of uniformly distributed photocells 14, one below holdfast beam 8 and the other below blade 7. There are similar rows of sources of light distributed along the inner surface 17 of bent 9. When a stack of material is positioned for cutting on the surface 3*a* of bench 3, one or more of the light barriers associated with holdfast beam 8 will be actuated in accordance with the height of the stack. Again, the light barriers between the material-contact surface 8*a* of holdfast beam 8 and the top 1*a* of the material that is to be cut will be deactivated as holdfast beam 8 rises off the stack in the direction indicated by arrow E. The same situation will occur among the light barriers below blade 7 as it descends and rises. The number of passive light barriers represents the distance between the material-contact surface 8*a* of holdfast beam 8 and the top 1*a* of the material 1 that is to be cut or between the sharp edge 7*a* of blade 7 and the surface 3*a* of bench 3, which can be exploited to obtain the distance of edge 7*a* from the top of the material. The electric circuitry that operates in conjunction with the hydraulic system actuating holdfast beam 8 and the crankshaft for blade 7 is designed in this embodiment such that in the presence of a definite distance, meaning in the event that a section of light barriers representing distance Z as a definite distance is not actuated, the rise of blade 7 or holdfast beam 8 will be immediately or soon terminated. Components similar to those illustrated in FIGS. 1 through 5 are labeled with the same numbers in FIG. 6, and the various embodiments function similarly unless otherwise specified.

I claim:

1. A method of optimizing a cutting process in a cutting machine, comprising the steps of: stacking material to be cut in a stack with a top on a bench; descending a holdfast beam onto said material before being cut to hold said material fast; descending a guillotine blade perpendicularly to a surface of the bench and cutting the material; lifting said blade and said beam after said material has been cut with a lower edge of said beam following a sharp edge of said blade; providing a definite distance between said blade and the top of the stack while said blade lifts subsequent to cutting the material; terminating the lift of the blade at an upper end of at least said definite distance; said definite distance being detected by a pick-up mounted stationary on said holdfast beam, said pick-up detecting positions of the blade when lifting in relation to said holdfast beam, said holdfast beam being hydraulically operated; and initiating the lift of said hydraulically operated holdfast beam when said definite distance is detected by said pick-up.

2. A method as defined in claim 1, wherein said blade is hydraulically actuated.

3. A method as defined in claim 1, wherein said blade is mechanically actuated by a crankshaft, and said blade descends after exceeding said upper end, descent of said blade terminating at least at said upper end of said distance.

4. A method as defined in claim 1, wherein motion of said blade terminates when said definite distance is 10 to 20 mm from the top of said stack.

5. A method as defined in claim 1, wherein said pick-up on the holdfast beam determines the position of said sharp edge of said blade relative to said holdfast beam, said pick-up being mounted on said holdfast beam away from a contact surface of said beam with said material.

6. A method as defined in claim 1, wherein said pick-up determines positions of said holdfast beam in relation to said blade inductively.

7. A method as defined in claim 1, wherein said holdfast beam rises farther when said material is soft than when said material is hard.

8. A method as defined in claim 1, wherein another definite distance between said holdfast beam and the top of said stack is detected while said holdfast beam lifts from the material being cut, lifting of the holdfast beam terminating when said other definite distance is detected.

9. A method as defined in claim 8, wherein the lifting of the holdfast beam terminates when said other definite distance is 10 to 20 mm from the material being cut.

10. A method as defined in claim 33, wherein said other definite distance is defined between said lower edge of said holdfast beam and the top of the stack and is detected by an additional pick-up mounted stationary on said holdfast beam and following said holdfast beam as said holdfast beam lifts.

11. A method as defined in claim 1, wherein the material being cut is advanced relative to said blade when said definite distance between has been detected.

12. A method as defined in claim 1, wherein said pickup has a plurality of stationary detection sites for detecting the position of the lower edge of said holdfast beam and the top of the stack relative to said bench, said stationary detection sites detecting also the position of the sharp edge of the blade relative to the top of the stack.

* * * * *